US010663896B2

(12) United States Patent
Itoh

(10) Patent No.: US 10,663,896 B2
(45) Date of Patent: May 26, 2020

(54) FIXING DEVICE AND IMAGE FORMING APPARATUS

(71) Applicant: CANON KABUSHIKI KAISHA, Tokyo (JP)

(72) Inventor: Masatoshi Itoh, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/515,578

(22) Filed: Jul. 18, 2019

(65) Prior Publication Data

US 2020/0033769 A1 Jan. 30, 2020

(30) Foreign Application Priority Data

Jul. 27, 2018 (JP) ..... 2018-141077

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ..... G03G 15/2039; G03G 15/206
See application file for complete search history.

(56) References Cited

U.S. PATENT DOCUMENTS

2005/0069337 A1* 3/2005 Suzumi ..... G03G 15/2003 399/88
2006/0165446 A1* 7/2006 Kikuchi ..... G03G 15/2064 399/329
2011/0081157 A1* 4/2011 Mitsuoka ..... G03G 15/2039 399/69
2011/0236089 A1* 9/2011 Tanaka ..... G03G 15/2053 399/329

FOREIGN PATENT DOCUMENTS

JP 4-326387 A 11/1992
JP 7-129009 A 5/1995
JP 2002-311749 A 10/2002
JP 2011-248054 A 12/2011

* cited by examiner

*Primary Examiner* — Sandra Brase
(74) *Attorney, Agent, or Firm* — Canon U.S.A., Inc. IP Division

(57) ABSTRACT

A fixing device to fix a toner image on a recording paper while transporting the recording paper bearing the toner image through a nip portion includes a first rotator, a second rotator, a heating unit, a temperature measuring element, a control unit, and a voltage applying unit. The second rotator forms the nip portion together with the first rotator. The heating unit heats the first rotator. The temperature measuring element measures temperature of the first rotator or the heating unit. The control unit controls power supplied to the heating unit in accordance with the temperature measured by the temperature measuring element. The voltage applying unit applies voltage to the second rotator. The second rotator includes a conductive layer having an attribute of changing resistance depending on temperature. The fixing device measures temperature of the second rotator by measuring the resistance of the conductive layer of the second rotator.

5 Claims, 10 Drawing Sheets

FIXING DEVICE AND IMAGE FORMING APPARATUS

BACKGROUND

Field

The present disclosure relates to a fixing device installed in an image forming apparatus, such as a copier or a printer, and the image forming apparatus including the fixing device.

Description of the Related Art

An image forming apparatus using an electrophotographic recording system includes a fixing device that fixes a toner image on a recording medium. Such a fixing device is implemented as various kinds of products. One example of these products gradually drops a control target temperature as the number of prints increases.

When printing is started while the fixing device is in a cooled state, at first the heat of a heater is mostly transferred to a pressure roller. It is thus necessary to set the control target temperature of the fixing device at a relatively high level so as to keep the heat to be applied also to recording papers. Afterwards, when the pressure roller becomes heated as the number of prints increases, sufficient fixability of toner images can be achieved by using the control target temperature that is lowered. If printing is repeated without gradually lowering the control target temperature, heat transferred to recording papers becomes excessive as the number of prints increases and this consequently causes hot offset. Japanese Patent Laid-Open No. 2002-311749 discloses a technology in which the control target temperature is set in accordance with the estimated temperature of the pressure roller.

As the speed of a printer increases with the development of printer's capability, the control target temperature necessary for fusing toner rises. In contrast, the threshold relating to hot offset caused by applying excessive heat to toner is not changed by the increase of the speed of the printer. As a result, the increase of the speed of the printer decreases the difference between the heat level at which fixing failure is caused by insufficient heat applied to toner and the heat level at which hot offset is caused by excessive heat.

Therefore, not to cause fixing failure or hot offset in a high-speed printer, the precision of determining the control target temperature in accordance with the degree of heat in a pressure roller is very important.

Concerning the interval between recording papers when a fixing device performs fixing processing for the recording papers, there are various cases such as serial printing, intermittent printing, and the case in which the interval between fixing processing operations increases because the interval between recording papers increases due to various factors. When the interval between fixing processing operations varies, the amount of heat received by a pressure roller from a heater also varies. Thus, it is difficult to precisely estimate the temperature of the pressure roller in consideration of various cases. If the estimated temperature of the pressure roller is different from the actual temperature, fixing failure or hot offset may occur. If, alternatively, a sensor for directly monitoring the temperature of the pressure roller is used, the cost accordingly increases.

SUMMARY

The present disclosure provides a fixing device in which the optimum control target temperature can be set without increasing the cost.

According to an aspect of the present disclosure, a fixing device to fix a toner image on a recording paper while transporting the recording paper bearing the toner image through a nip portion includes a first rotator, a second rotator to form the nip portion together with the first rotator, a heating unit configured to heat the first rotator, a temperature measuring element configured to measure temperature of the first rotator or the heating unit, a control unit configured to control power supplied to the heating unit in accordance with the temperature measured by the temperature measuring element, and a voltage applying unit configured to apply voltage to the second rotator, wherein the second rotator includes a conductive layer having an attribute of changing resistance depending on temperature, and wherein the fixing device is configured to measure temperature of the second rotator by measuring the resistance of the conductive layer of the second rotator.

Further features of the present disclosure will become apparent from the following description of exemplary embodiments with reference to the attached drawings.

DESCRIPTION OF THE EMBODIMENTS

First Embodiment

Figure 1:
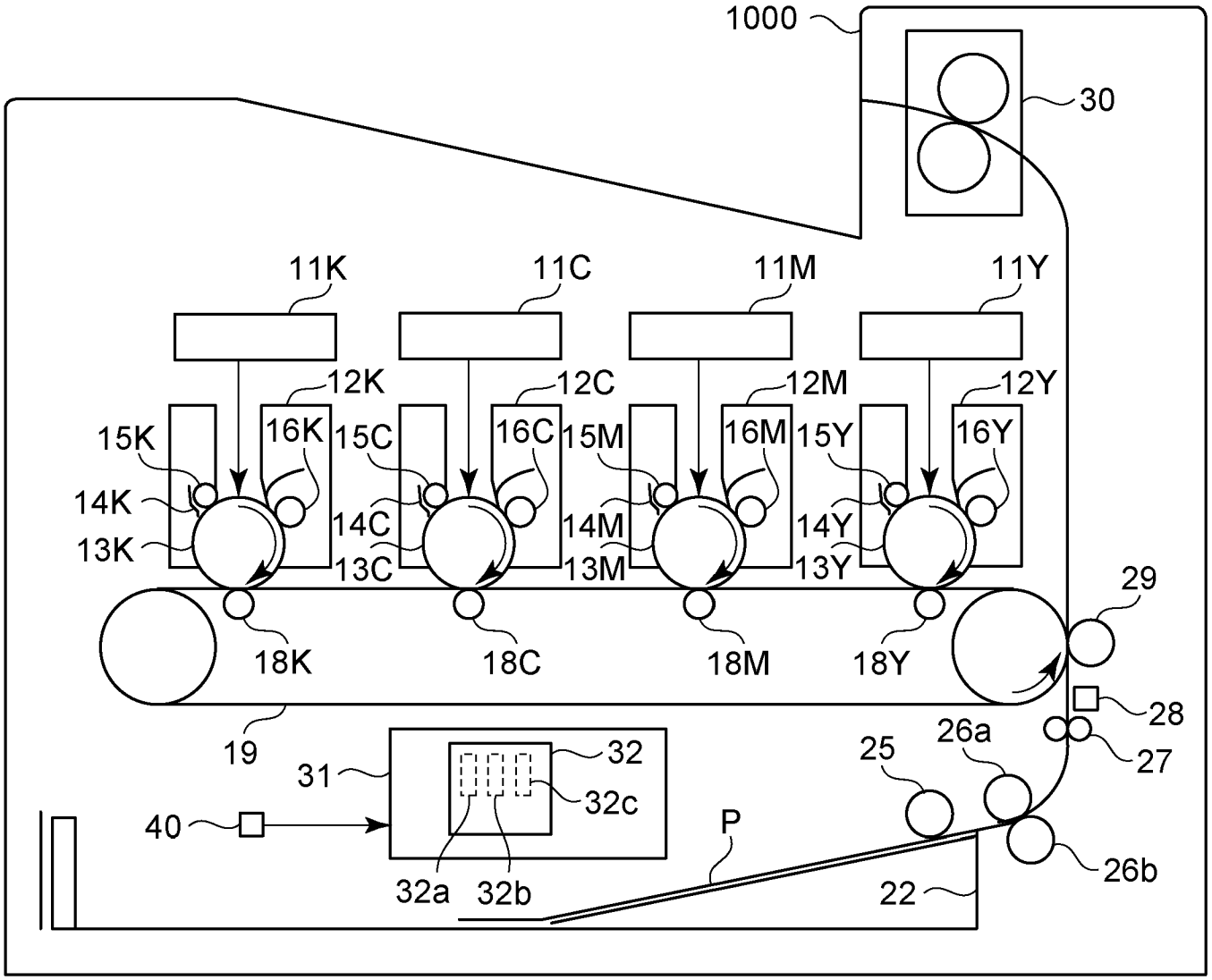
FIG. 1 illustrates a configuration of an image forming apparatus.

A first embodiment of the present disclosure is described below with reference to FIGS. 1 to 7. FIG. 1 illustrates a configuration of a color printer (an image forming apparatus) 1000 that forms toner images on recording papers P by using an electrophotographic recording system. The printer 1000 is configured to form a full-color image by layering toner images respectively formed with four colors of toner, namely yellow (Y), magenta (M), cyan (C), and black (K). To form toner images of these colors, laser scanners (11Y, 11M, 11C, 11K) and cartridges (12Y, 12M, 12C, and 12K) are provided. The cartridges (12Y, 12M, 12C, and 12K) include photosensitive members (13Y, 13M, 13C, and 13K) that each rotates in the direction indicated by the arrow in the drawing and charging rollers (15Y, 15M, 15C, and 15K) that electrically charge the respective photosensitive member. The cartridges (12Y, 12M, 12C, and 12K) also include development rollers (16Y 16M, 16C, and 16K) that supply toner to the respective photosensitive members and cleaners (14Y, 14M, 14C, and 14K) that clean the respective photosensitive members. The photosensitive member (13Y, 13M, 13C, and 13K) are all in contact with an intermediate transfer belt 19. Primary transfer rollers (18Y, 18M, 18C, and 18K) are positioned to face the respective photosensitive members while the intermediate transfer belt 19 is interposed between the primary transfer rollers and the photosensitive members. Toner images formed on the photosensitive members are layered on the intermediate transfer belt 19.

A sheet feeding roller 25, separation rollers 26*a* and 26*b*, and resist rollers 27 are positioned downstream with respect to a cassette 22 storing the recording papers P in a direction in which a recording paper are transported. A transport sensor 28 that detects a recording paper is positioned downstream with respect to the resist rollers 27. A secondary transfer roller 29 that is in contact with the intermediate transfer belt 19 and that is used for transferring a toner image from the intermediate transfer belt 19 to the recording paper P is positioned downstream with respect to the transport sensor 28. A fixing unit 30 that is used for fixing a toner image on the recording paper P is positioned downstream with respect to the secondary transfer roller 29.

A controller 31 is a control unit of the printer 1000 and constituted by a central processing unit (CPU) 32 including, for example, a read-only memory (ROM) 32*a*, a random-access memory (RAM) 32*b*, and a tinier 32*c*, and various input/output control circuits (not shown). Since the electrophotographic recording system in which a toner image is formed on the recording paper P by using the devices described above is generally known, detailed description thereof is on ted. The printer 1000 includes an environmental temperature sensor 40 that gauges the environmental temperature of external air and thus can determine the setting for image forming in accordance with the gauged environmental temperature.

Figure 2:
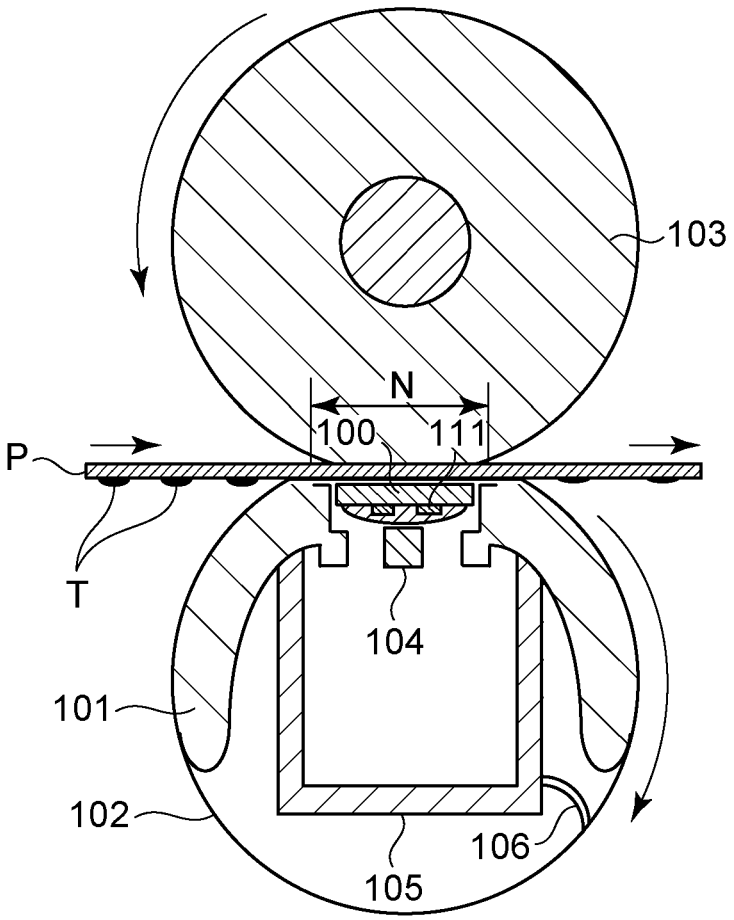
FIG. 2 is a sectional view of a fixing unit.

FIG. 2 is a sectional view of the fixing unit 30. The fixing unit 30 includes a cylindrically formed film (a first rotator) 102, a heater (a heating unit) 100 that is in contact with the inner surface of the film 102, a heater holder 101 holding the heater 100, and a stay 105 made of metal and used for strengthening the heater holder 101. The fixing unit 30 involves a heating element 111 of the heater 100. The fixing unit 30 also includes a pressure roller 103 (a second rotator) forming a fixing nip portion N with the heater 100 and the film 102 interposed between the pressure roller 103 and the heater 100 and includes a thermistor (a temperature measuring element) 104 that measures the temperature of the heater 100. A conductor 106 is used for coupling the film 102 to GND (ground) via the stay 105 and is in contact with the inner surface of the film 102.

The pressure roller 103 is driven by a motor in the direction of the arrow in the drawing. The pressure roller 103 rotates and the film 102 accordingly rotates. The power supplied to the heater 100 (more precisely, the heating element 111) is controlled in such a manner as to maintain the temperature measured by the thermistor 104 at the level of the control target temperature. While the heater 100 maintains temperature suitable for fixing toner images, the recording paper P bearing a toner image is passed through the fixing nip portion N, and as a result, the toner image is fixed on the recording paper P.

Figure 3:
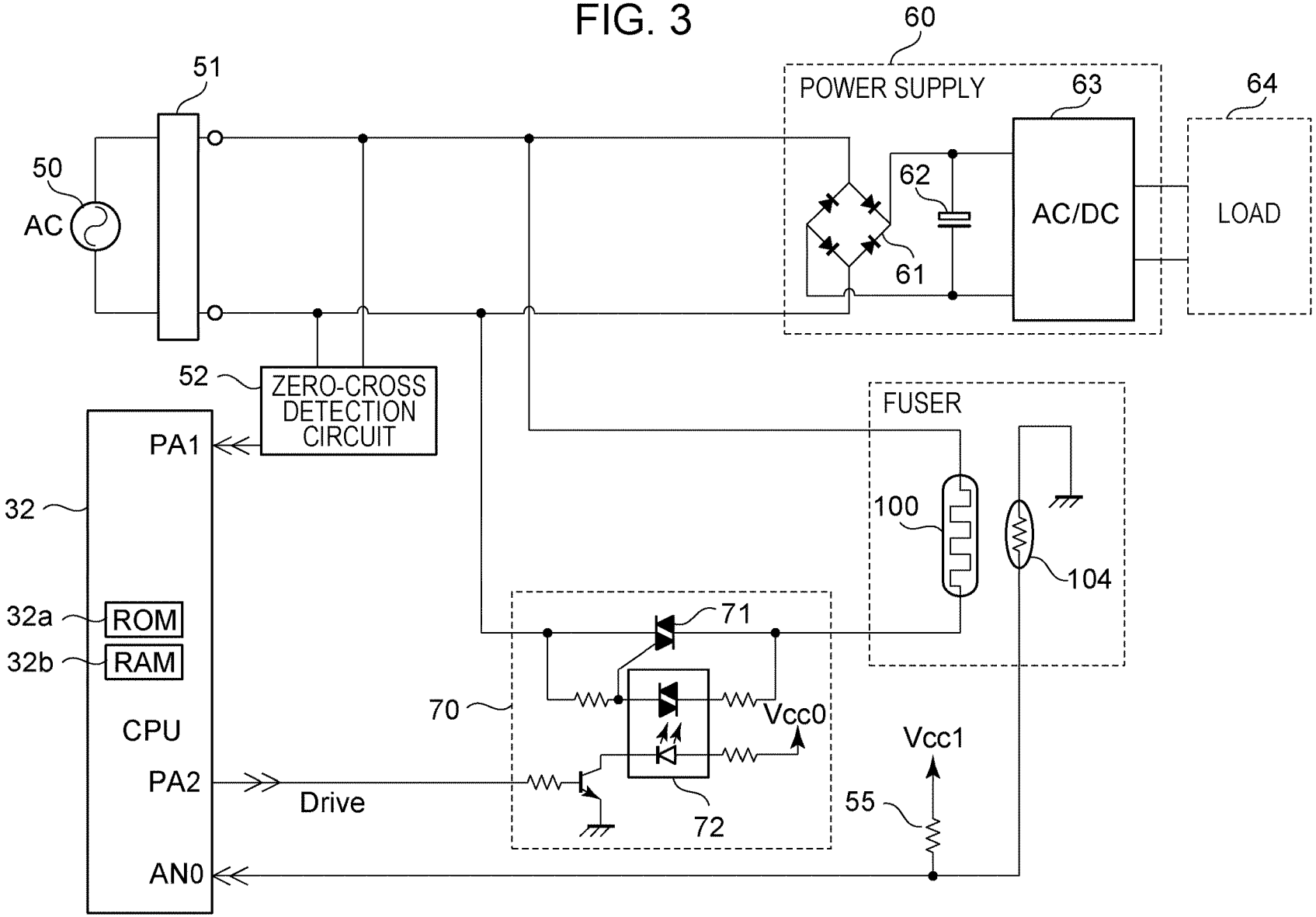
FIG. 3 illustrates circuitry for driving a heater.

Next, circuitry for driving the heater 100 is described with reference to FIG. 3. The circuitry includes an alternating-current (AC) power supply 50. A switching power supply (hereinafter referred to as the power supply) 60 and the heater 100 are coupled to the AC power supply 50 via the AC filter 51. A CPU 32 controls, for example, power supplied to the heater 100 and is composed of, for example, input/output ports, the ROM 32*a*, and the RAM 32*b*.

A zero-cross detection circuit 52 is also coupled to the AC power supply 50 via the AC filter 51. The signal that is output by the zero-cross detection circuit 52 is used as a timing signal used for performing phase control for the heater 100 with respect to each half-wave of an AC waveform. The power supplied to the heater 100 is controlled by the CPU 32 controlling a heater drive circuit 70 constituted mainly by a triode for alternating current (triac) 71, such as an electronic amplifying vacuum tube, and a triac coupler 72. The CPU 32 controls the heater drive circuit 70 to maintain the temperature measured by the thermistor 104 at the level of the control target temperature.

The thermistor 104 is a component in which resistance changes as temperature changes. A divided voltage obtained as the result of distributing a voltage Vcc1 between the thermistor 104 and a fixed resistor 55 is input to an analog input port AN0 of the CPU 32. The CPU 32 measures the temperature of the heater 100 in accordance with the divided voltage measured at the input port AN0 and a voltage-temperature conversion table that is preset in the CPU 32. The CPU 32 outputs from an output port PA2 a Drive signal used for driving the heater drive circuit 70 in accordance with the measured temperature. The Drive signal that is output from the output port PA2 is used for performing phase control for the heater 100 in accordance with the zero-cross signal that is output by the zero-cross detection circuit 52. The zero-cross signal is input to an input port PA1 of the CPU 32.

The power supply 60 includes a diode bridge 61 that rectifies AC voltage, a smoothing capacitor 62, and a DC-DC converter 63 that is disposed in a stage following the smoothing capacitor 62 and used for generating direct-current (DC) voltage. The DC voltage generated by the power supply 60 is supplied to secondary load 64 such as the control unit or a drive unit of the printer 1000.

Figure 4:
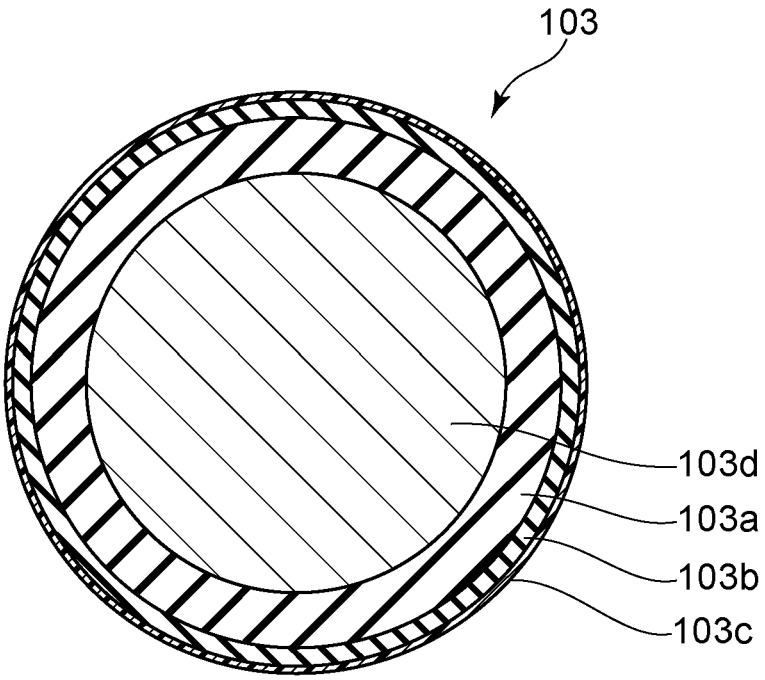
FIG. 4 is a sectional view of a pressure roller.

Next, the pressure roller 103 is described with reference to FIG. 4. The layers of the pressure roller 103 are structured by a. solid rubber layer (an elastic layer) 103*a* formed of silicone rubber, a highly heat-conductive rubber layer (a conductive layer) 103*b*, and a release layer 103*c* formed of fluorocarbon resin, which are layered on the outer circumference of a metal core 103*d*. The highly heat-conductive rubber layer 103*b* is formed on the solid rubber layer 103*a* to have an even thickness and is made of silicone rubber in which carbon fibers serving as heat conductive filler are dispersed. Because the highly heat-conductive rubber layer 103*b* contains carbon fibers, the highly heat-conductive rubber layer 103*b* has conductivity. The highly heat-conductive rubber layer 103*b* has an attribute of changing resistance with change in temperature. It should be noted that, while the pressure roller 103 including a highly heat-conductive rubber layer is used. in this embodiment, the pressure roller 103 only needs to include a conductive layer to measure temperature as described later. The material of the conductive layer may have an attribute of largely changing resistance with change in temperature. Since the highly heat-conductive rubber layer 103*b* contains carbon fibers, the highly heat-conductive rubber layer 103*b* has a positive temperature coefficient (PTC). Alternatively, the highly heat-conductive rubber layer 103*b* may have a negative temperature coefficient (NTC). As the temperature of the pressure roller 103 changes, the resistance of the highly heat-conductive rubber layer 103*b* changes. By measuring this change, the temperature of the pressure roller 103 can be measured.

Next, a configuration of circuitry for measuring the temperature of the pressure roller 103 is described with reference to FIGS. 5A and 5B. A voltage applying circuit 81 receives a signal from an output port PA3 of the CPU 32 and then applies a sine-wave voltage with 10-kHz frequency to the metal core 103*d* of the pressure roller 103. While a sine-wave voltage with 10-kHz frequency is applied in this embodiment, the frequency and the waveform should not be limited to the examples in this embodiment.

Figure 5A:
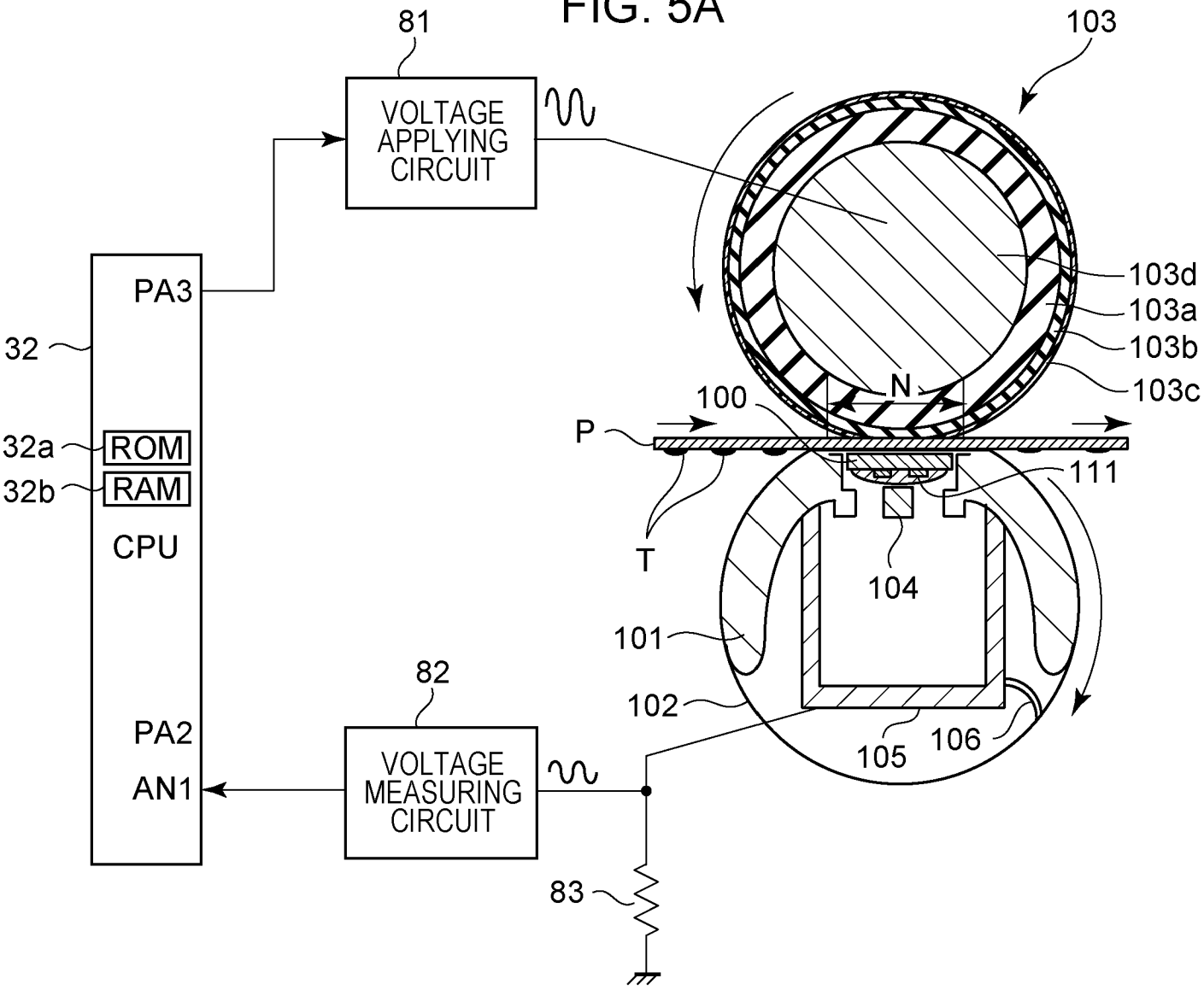
FIGS. 5A and 5B illustrate circuitry for measuring temperature.
Figure 5B:
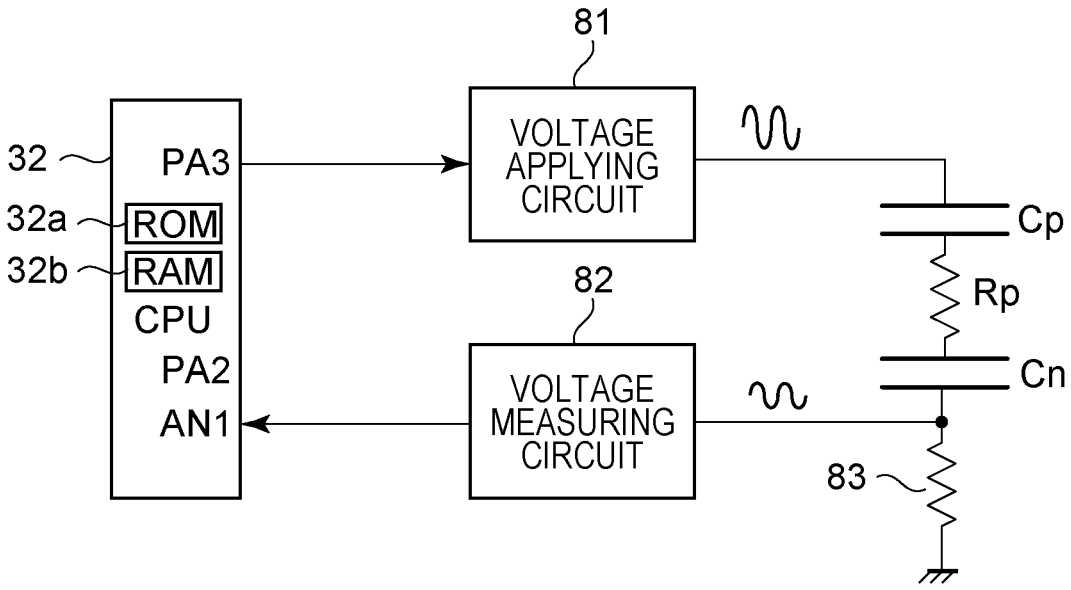

As illustrated in FIG. 5A, the metal core 103*d*, the solid rubber layer 103*a*, the highly heat-conductive rubber layer 103*b*, the release layer 103*c*, the film 102, the conductor 106, the stay 105, and resistor 83 are disposed between the voltage applying circuit 81 and GND. This configuration is illustrated as an equivalent circuit diagram in FIG. 5B. Specifically, the capacitance between the metal core 103*d* and the highly heat-conductive rubber layer 103*b* is represented by Cp, the resistance of the highly heat-conductive rubber layer 103*b* of the pressure roller is represented by Rp, and the capacitance of the nip portion N between the film 102 and the pressure roller 103 is represented by Cn. A divided voltage obtained as the result of distributing a voltage to Cp, Rp, Cn, and the resistor 83 is input to a voltage measuring circuit 82. A base layer of the film 102 in contact with the conductor 106 is made of stainless steel and thus a conductive layer. As a result, the resistance between the conductive layer of the film 102 and the stay 105 is relatively small and can be ignored.

The resistance of the resistor 83 may be determined in consideration of a ratio with respect to the combined impedance of Rp, Cp, and Cn. The voltage measuring circuit 82 measures amplitude of the waveform of the input voltage and reports the measured amplitude to the CPU 32. While the voltage measuring circuit according to this embodiment measures amplitude of the waveform of an input voltage, the voltage measuring circuit is not limited to the example in this embodiment and may measure, for example, the effective value of the waveform of an input voltage.

The CPU 32 measures the temperature of the pressure roller 103 by converting voltage information that is input to the voltage measuring circuit 82 into temperature information in accordance with a prepared table or a mathematical expression. Since the resistance Rp changes with change of the temperature of the pressure roller 103, the voltage that is input to the voltage measuring circuit 82 changes accordingly. Therefore, measuring the voltage that is input to the voltage measuring circuit 82 is equivalent to measuring the resistance of the highly heat-conductive rubber layer 103*b* that is a conductive layer. By exploiting the mechanism described above, the temperature of the pressure roller 103 can be measured.

The equivalent circuit of the voltage applying circuit 81 in accordance with this embodiment should not be construed in a limiting sense and may be an equivalent circuit in which the capacitance Cp between the metal core 103*d* and the highly heat-conductive rubber layer 103*b* is removed.

Figure 6A:
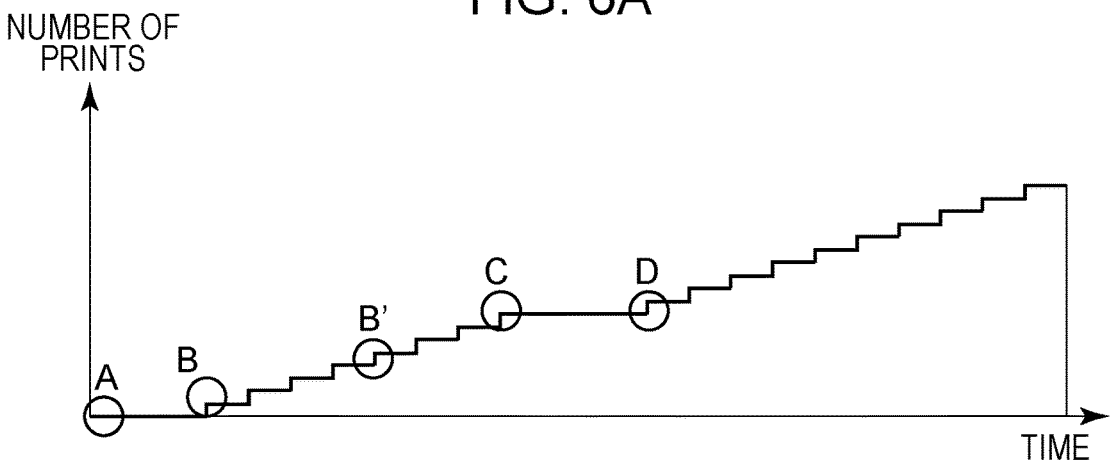
FIGS. 6A to 6E illustrate transitions of temperature of the pressure roller.
Figure 6B:
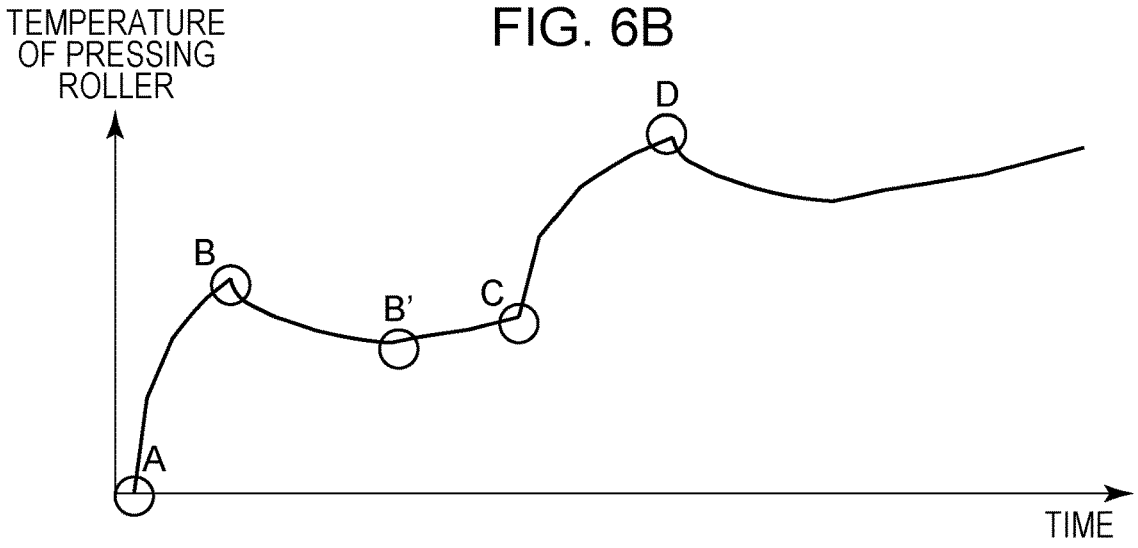

Next, transitions of temperature of the pressure roller 103 and waveforms corresponding to measured temperatures of the pressure roller at different times are described with reference to FIGS. 6A to 6E. In FIG. 6A, the horizontal axis corresponds to time and the vertical axis corresponds to the number of prints. In FIG. 6B, the horizontal axis corresponds to time and the vertical axis corresponds to the temperature of the pressure roller 103.

When an instruction is provided to start printing, supplying power to the heater 100 is started and rotating the pressure roller 103 is also started. In this stage, although the heater 100 generates heat and applies the heat to the pressure roller 103, the heat is not greatly transferred to the recording paper P. As a result, as indicated by the temperature curve of the pressure roller 103 between times A and B in the FIG. 6B, the temperature of the pressure roller 103 steeply rises. The recording paper P starts passing through the nip portion N of the fixing unit 30 at the time B, and responsively, the heat of the pressure roller 103 is transferred to the recording paper P. Thus, as indicated by the temperature curve between the time B and a time B', the temperature of the pressure roller 103 drops as the number of the passing recording papers P increases. When several numbers of the recording papers P have passed through the nip portion N of the fixing unit 30 (the time B'), the amount of heat transferred to the recording paper P and the amount of heat supplied to the pressure roller 103 by the heater 100 at times of intervals between papers are balanced. As a result, the decrease of the temperature of the pressure roller 103 stops.

The period between times C and Din FIG. 6A is a time for waiting for the recording paper P entering the fixing unit 30 due to a factor other than the fixing unit 30, such as a cleaning sequence of the intermediate transfer belt 19. Since the heat of the pressure roller 103 is not transferred to the recording paper P during this period, the temperature of the pressure roller 103 steeply rises again as indicated by the temperature curve between the times C and D in FIG. 6B.

Figure 6C:
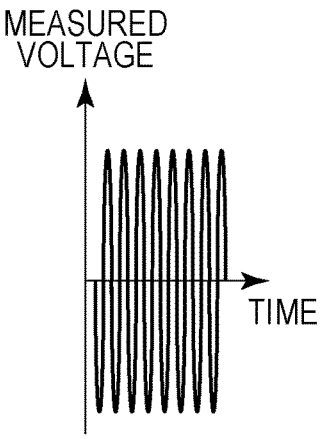
Figure 6D:
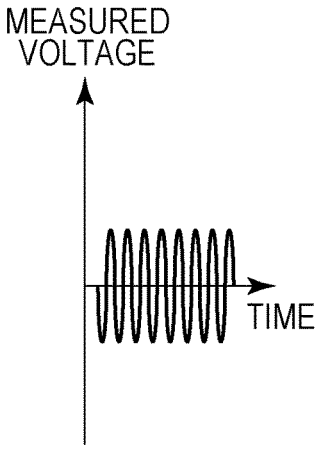
Figure 6E:
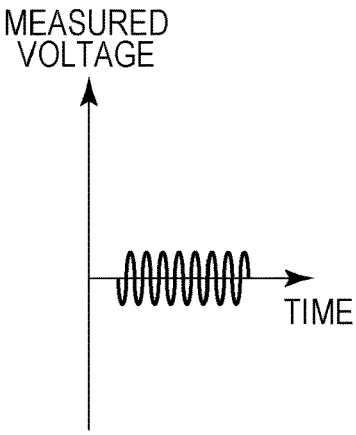

FIGS. 6C, 6D, and 6E illustrate waveforms corresponding to measured temperatures of the pressure roller 103 at the times A, B, and D. These waveforms represent waveforms that are input to the voltage measuring circuit 82. At the time A, since the temperature of the pressure roller 103 is relatively low, the amplitude of the waveform corresponding to the measured temperature is relatively large as illustrated in FIG. 6C. As the temperature of the pressure roller 103 increases, the resistance Rp of the pressure roller 103 increases, and thus, the amplitude of the waveform corresponding to the measured temperature gradually decreases as illustrated in FIGS. 6D and 6E. In this embodiment, the voltage measuring circuit 82 measures the temperature of the pressure roller 103 such that the voltage measuring circuit 82 measures the amplitude of a waveform corresponding to a measured temperature and the CPU 32 converts the information into the temperature of the pressure roller 103.

In accordance with the measured temperature of the pressure roller 103, the control target temperature of the heater 100 is changed. As a result, high-quality image can be provided.

Figure 7:
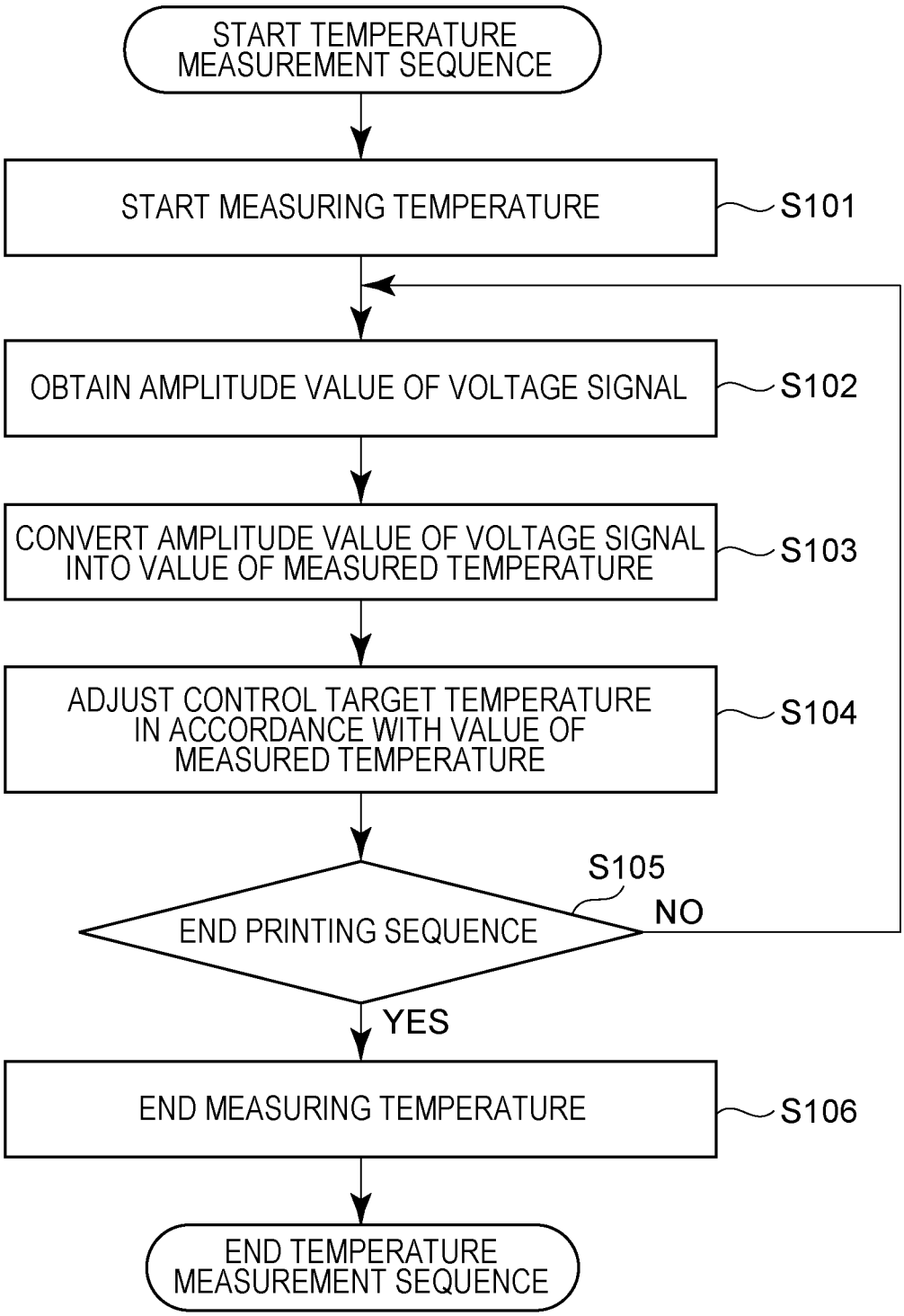
FIG. 7 is a flowchart of control processing according to a first embodiment.

Next, specific control is described by using a flowchart in FIG. 7. It should be noted that the control processing illustrated by the flowchart is performed by the CPU 32 in accordance with a program previously stored in the ROM 32*a*.

When the printing sequence is started, the CPU 32 starts control to supply power to the heater 100. Subsequently, when the temperature measured by the thermistor 104 reaches a predetermined temperature, the CPU 32 starts control to rotate the pressure roller 103. When the pressure roller 103 starts rotating, the CPU 32 starts a temperature measurement sequence illustrated in FIG. 7. The CPU 32 starts the temperature measurement sequence from S101 in which the CPU 32 instructs the voltage applying circuit 81 to apply voltage, Subsequently, the CPU 32 obtains an amplitude value of the voltage signal in S102 and converts the amplitude value of the voltage signal into a value of a measured temperature by referring to a prepared table in S103. The CPU 32 then adjusts the control target temperature of the heater 100 in accordance with a prepared temperature adjustment table and the value of the measured temperature of the pressure roller 103. The CPU 32 repeats the processes from S102 to S104 until the printing sequence ends in S105. When determining that the printing sequence has ended in S105, the CPU 32 ends measuring temperature in S106, which is the end of the temperature measurement sequence of the pressure roller.

The control described above allows measurement of the temperature of the pressure roller with use of inexpensive configuration, and as a result, high-quality images without fixing failure or hot offset can be provided for users.

Second Embodiment

In the first embodiment described above, the configuration in which the temperature of the pressure roller 103 is measured by applying AC voltage to the pressure roller 103 is described. By contrast, in this embodiment, a configuration in which the temperature of the pressure roller 103 is measured by applying DC voltage is described. The following description focuses mainly on differences between this embodiment and the first embodiment, and the description of the same configurations indicated by the same reference characters is omitted.

Figure 8A:
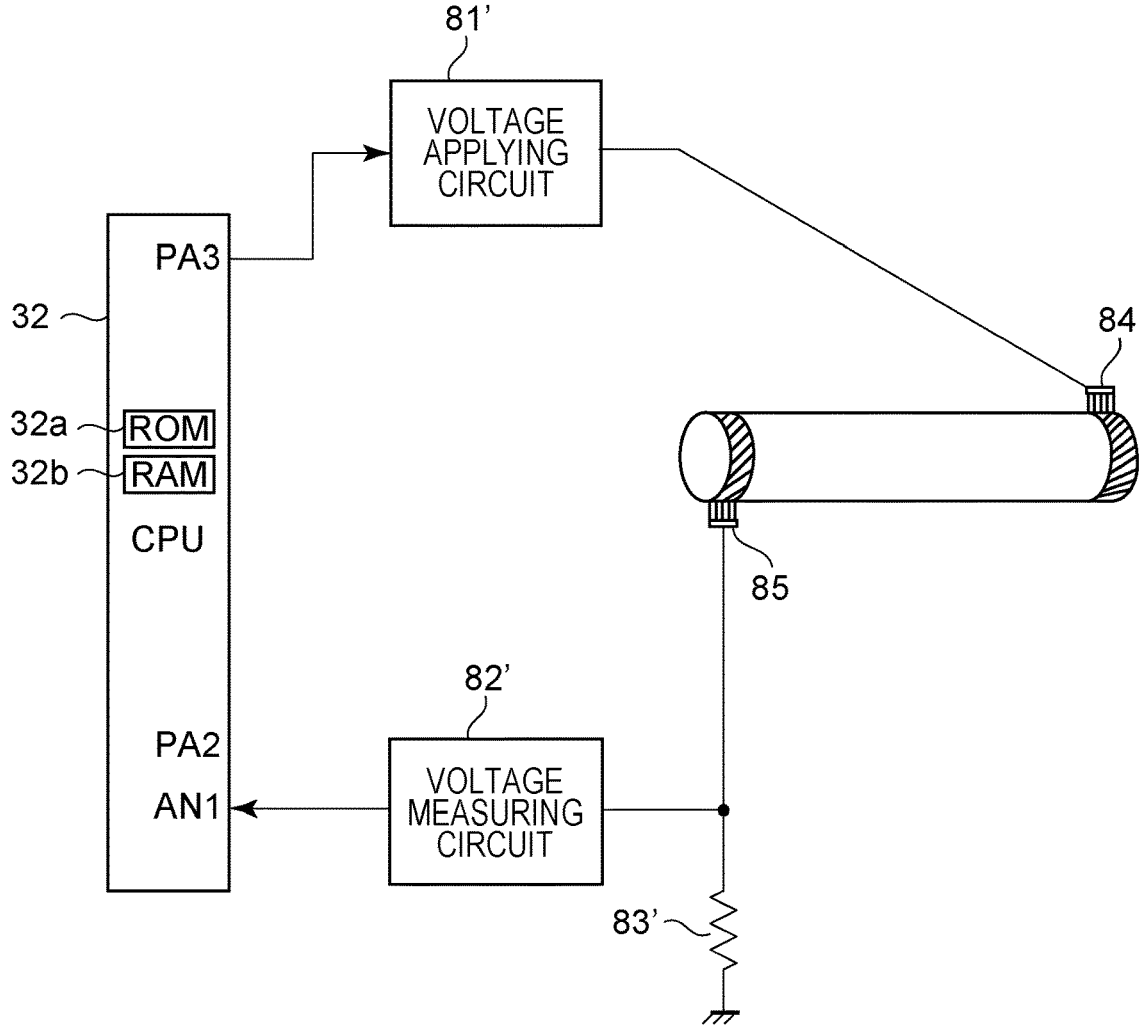
FIGS. 8A and 8B illustrate circuitry for measuring temperature, in accordance with a second embodiment.
Figure 8B:
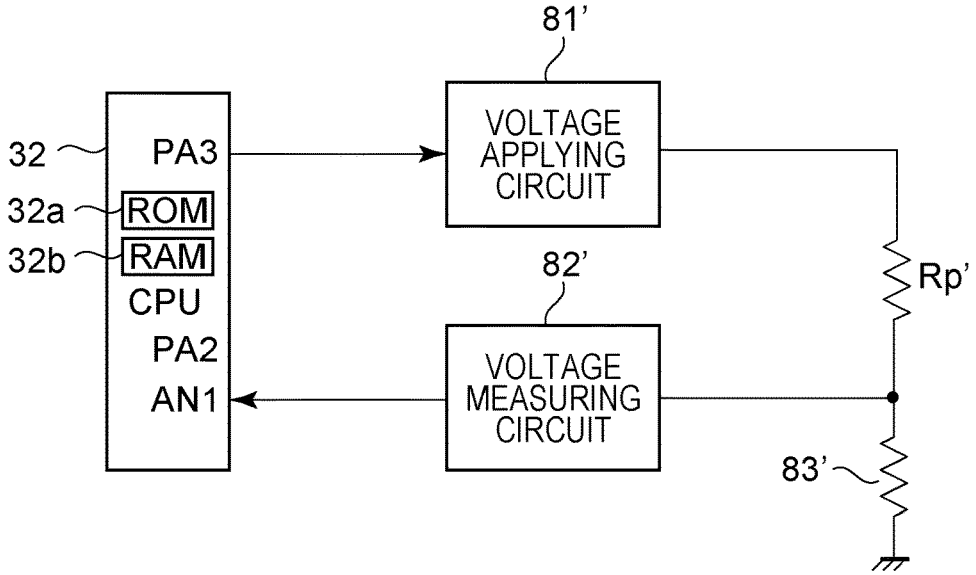

A configuration of circuitry used for measuring the temperature of the pressure roller 103 is described with reference to FIGS. 8A and 8B. As illustrated in FIG. 8A, the highly heat-conductive rubber layer 103*b* is exposed at both ends of the pressure roller 103 in the longitudinal direction. One exposed portion of the highly heat-conductive rubber layer 103*b* is electrically coupled to a voltage applying circuit 81' via a conductive brush 84 and the other exposed portion of the highly heat-conductive rubber layer 103*b* is electrically coupled to a resistor 83' and a voltage measuring circuit 82' via a. conductive brush 85.

The voltage applying circuit 81' receives a signal from the output port PA3 of the CPU 32 and then applies a predetermined DC voltage to the pressure roller 103. The voltage applying path illustrated in FIG. 8A is illustrated as an equivalent circuit diagram in FIG. 8B. A divided voltage obtained as the result of distributing a voltage to the resistance of the highly heat-conductive rubber layer 103*b* of the pressure roller 103 represented by Rp' and the resistor 83' is input to the voltage measuring circuit 82'. The voltage measuring circuit 82' measures the input voltage and reports information about the measured input voltage to the CPU 32.

The CPU 32 measures the temperature of the pressure roller 103 by converting voltage information that is input to the voltage measuring circuit 82' into temperature information in accordance with a prepared table or a mathematical expression. Since the resistance Rp' changes with change of the temperature of the pressure roller 103, the voltage that is input to the voltage measuring circuit 82' changes accordingly. By exploiting the mechanism described above, the temperature of the pressure roller 103 can be measured.

Figure 9:
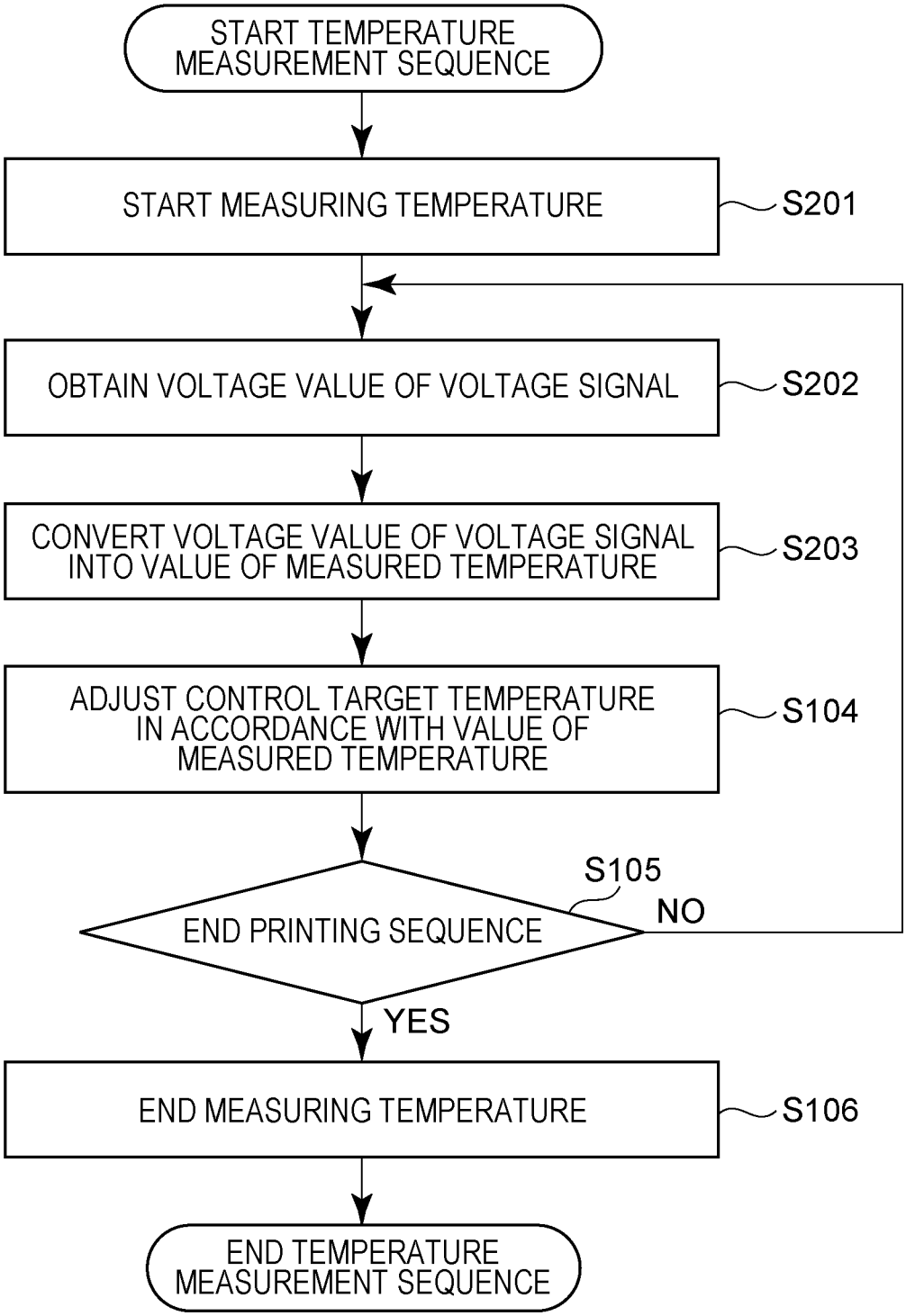
FIG. 9 is a flowchart according to the second embodiment.

Specific control is described by using a flowchart in FIG. 9. it should be noted that the control processing illustrated by the flowchart is performed by the CPU 32 in accordance with a program previously stored in the ROM 32*a*.

The CPU 32 starts a temperature measurement sequence illustrated in FIG. 9. The CPU 32 instructs the voltage applying circuit 81 to apply voltage in S201. Responsively, a DC voltage is applied to the pressure roller 103 and the voltage measuring circuit 82' starts measuring temperature. The CPU 32 obtains a voltage value of a voltage signal in S202 and converts the voltage value of the voltage signal into a value of a measured temperature of the pressure roller 103 by referring to a prepared table in S203. The CPU 32 adjusts the control target temperature of the heater 100 in accordance with a prepared temperature adjustment table and the value of the measured temperature of the pressure roller 103. The CPU 32 repeats the processes from S202 to S104 until the printing sequence ends in S105. When determining that the printing sequence has ended in S105, the CPU 32 ends measuring temperature in S106, which is the end of the temperature measurement sequence of the pressure roller.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium, The storage medium may include, for example, one or more of a hard disk, a random-access memory (RAM), a read only memory (ROM), a storage of distributed computing systems, an optical disk (such as a compact disc (CD), digital versatile disc (MD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-141077, filed Jul. 27, 2018, which is hereby incorporated by reference herein in its entirety.

What is claimed is:

1. A fixing device to fix a toner image on a recording paper while transporting the recording paper bearing the toner image through a nip portion, the fixing device comprising:

a first rotator;

a second rotator to form the nip portion together with the first rotator;

a heating unit configured to heat the first rotator;

a temperature measuring element configured to measure temperature of the first rotator or the heating unit;

a control unit configured to control power supplied to the heating unit in accordance with the temperature measured by the temperature measuring element; and a voltage applying unit configured to apply voltage to the second rotator, wherein the second rotator includes a conductive layer having an attribute of changing resistance depending on temperature, and wherein the fixing device is configured to measure temperature of the second rotator by measuring the resistance of the conductive layer of the second rotator.

2. The fixing device according to claim 1, wherein the voltage applying unit is configured to apply alternating-current voltage to the second rotator.

3. The fixing device according to claim 1, wherein the voltage applying unit is configured to apply direct-current voltage to the second rotator.

4. The fixing device according to claim 1, wherein the control unit is configured to set a control target temperature of the fixing device by measuring the temperature of the second rotator.

5. An image forming apparatus comprising:

an image forming unit configured to form an image on a recording paper; and a fixing device to fix a toner image on a recording paper while transporting the recording paper bearing the toner image through a nip portion, wherein the fixing device includes:

a first rotator, a second rotator to form the nip portion together with the first rotator, a heating unit configured to heat the first rotator, a temperature measuring element configured to measure temperature of the first rotator or the heating unit, a control unit configured to control power supplied to the heating unit in accordance with the temperature measured by the temperature measuring element, and a voltage applying unit configured to apply voltage to the second rotator, wherein the second rotator includes a conductive layer having an attribute of changing resistance depending on temperature, and wherein the fixing device is configured to measure temperature of the second rotator by measuring the resistance of the conductive layer of the second rotator.

* * * * *